US009415486B2

(12) United States Patent
Ludtke et al.

(10) Patent No.: US 9,415,486 B2
(45) Date of Patent: Aug. 16, 2016

(54) GEARLESS RATCHET WITH INDICATOR

(71) Applicant: A&E Incorporated, Racine, WI (US)

(72) Inventors: Jonathan L. Ludtke, Waterford, WI (US); Timothy Alho, Pleasant Prairie, WI (US)

(73) Assignee: A & E Incorporated, Racine, WI (US)

( * ) Notice: Subject to any disclaimer, the term of this patent is extended or adjusted under 35 U.S.C. 154(b) by 259 days.

(21) Appl. No.: 14/227,789

(22) Filed: Mar. 27, 2014

(65) Prior Publication Data

US 2014/0290441 A1 Oct. 2, 2014

Related U.S. Application Data

(60) Provisional application No. 61/806,070, filed on Mar. 28, 2013.

(51) Int. Cl.
*B25B 13/46* (2006.01)

(52) U.S. Cl.
CPC ..... *B25B 13/462* (2013.01)

(58) Field of Classification Search
CPC ..... B25B 13/46; B25B 13/462
USPC ..... 81/58.1–63.2
See application file for complete search history.

(56) References Cited

U.S. PATENT DOCUMENTS 4,259,883 A * 4/1981 Carlson ..... B25B 13/06 81/60
5,174,176 A * 12/1992 Krivec ..... B25B 13/463 81/62
6,253,646 B1 * 7/2001 Chang ..... B25B 13/462 192/44
6,367,354 B1 * 4/2002 Mitchell ..... B25B 13/462 81/57.39
6,408,722 B1 * 6/2002 Chen ..... B25B 13/463 81/60

* cited by examiner

*Primary Examiner* — Hadi Shakeri
(74) *Attorney, Agent, or Firm* — Ryan Kromholz & Manion, S.C.

(57) ABSTRACT

The present invention relates to a one-way freewheel clutch type wrench, more specifically to an indicator mechanism for providing audible and/or tactile feedback when a one-way freewheel clutch wrench is rotated in the unrestricted, or "reloading", direction. The indicator mechanism has a ratchet wheel with teeth attached to a one-way freewheel clutch socket which interacts with at least one indicator located in a pocket of the box-end of the wrench.

10 Claims, 2 Drawing Sheets

GEARLESS RATCHET WITH INDICATOR

RELATED APPLICATIONS

This application claims the benefit of co-pending U.S. Provisional Patent Application Ser. No. 61/806,070, tiled on 28 Mar. 2013.

BACKGROUND OF THE INVENTION

Wrenches, specifically ratcheting wrenches are well known to those in the art, Generally, most ratcheting wrenches consist or a gear with teeth and a spring-loaded finger, or pawl making contact with the teeth. By the internal mechanics of these types of ratcheting wrenches, as the year rotates in an unrestricted direction the pawl rides along the teeth and when it passes over a tooth the spring will force the pawl back in contact with the gear. This creates an audible "click." The audible click signals to the user that the wrench is turning in the unrestricted. direction.

Alternatively, some wrenches employ a type of one-way freewheel clutch to provide one-way operation. This type of wrench may comprise a plurality of rollers placed in the space between the outer surface of a one-way freewheel clutch member having a through-hole for receiving an article to be turned and the inner surface of an outer box-end member. When the wrench turns in the restricted direction, the shape of the one-way freewheel clutch member promotes the wedging of the rollers between the one-way freewheel clutch member and the outer member, thereby essentially locking the two together. However, when burned in the unrestricted direction, the rollers will move along with the one-way freewheel clutch member along inside surface of the outer member. Unlike the ratcheting wrench, a one-way freewheel n clutch. wrench. makes no audible sound when turning in the unrestricted direction. This may be problematic as there is no audible or tactile feedback from the wrench. to know whether the wrench is "reloading" or just rotating along with the article being tightened or loosened.

SUMMARY OF THE INVENTION

The present invention relates to a one-way freewheel clutch type wrench, more specifically to an indicator mechanism for providing audible and tactile feedback when a one-way freewheel clutch wrench is rotating in the unrestricted direction. The mechanism indicator comprises a toothed wheel or "ratchet" wheel fixedly attached to a one-way freewheel clutch member and at least one indicator member which interacts with the ratchet wheel as it rotates relative to the wrench. handle in the unrestricted direction to create audible and tactile feedback to a user.

One aspect of the invention provides a gearless wrench having a box end; a freewheel clutch socket, with a collar, positioned within the box end; a ratchet wheel, with ratchet teeth, securely fastened to the collar of the freewheel clutch socket; and an indicator placed within the box end and in contact with the ratchet teeth.

The gearless wrench may also have a snap-ring groove located in the box end, a cover elate configured to cover the ratchet wheel and the indicator, and a snap-ring positioned against the cover plate and within the snap-ring groove to retain the freewheel clutch socket and the ratchet wheel, the indicator, and the cover plate within the box end. The indicator may be a leaf spring. The indicator may also be a plurality of leaf springs. The ratchet wheel may be friction-fit to the collar of the freewheel clutch socket.

Another aspect of the invention provides a gearless wrench configured to provide auditory and/or tactile feedback during reloading, the gearless wrench having a box end comprising an indicator pocket; a freewheel clutch socket, with a collar, positioned within the box end; a ratchet wheel, with ratchet teeth, securely fastened to the collar of the freewheel clutch socket; and an indicator placed within the indicator pocket and in contact with the ratchet teeth.

The gearless wrench may also have a snap-ring groove located in the box end, a cover plate configured to cover the ratchet and the indicator, and a snap-ring positioned against the cover plate and within the snap-ring groove to retain the freewheel clutch socket and the ratchet wheel, the indicator, and the cover plate within the box end. The indicator may be a leaf spring. The indicator may also be a plurality of leaf springs. The ratchet wheel may be friction-fit to the collar of the freewheel clutch socket.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
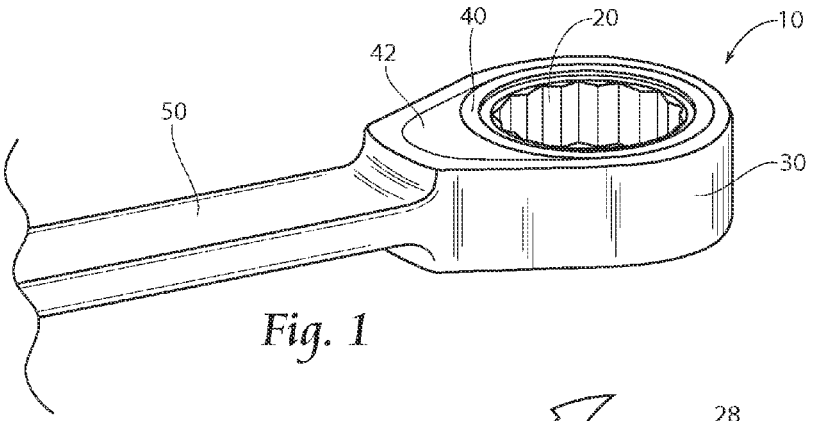
FIG. 1 is a perspective view of a one-way freewheel clutch wrench with indicator according to the present invention.

A completely assembled one-way freewheel clutch wrench 10 having a one-way freewheel clutch socket 20 inside a box-end 30 according to the present invention is shown in FIG. 1. Visible in this figure is a. snap ring 40 which maintains the placement of a cover plate 42 and the one-way freewheel clutch socket 20.

Figure 2:
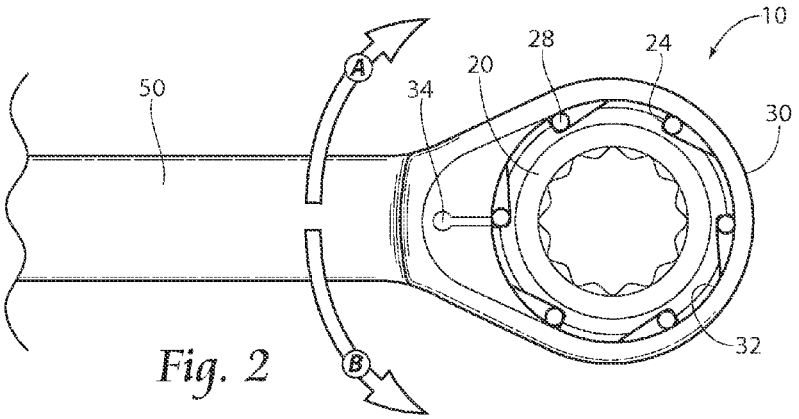
FIG. 2 is a top view of the wrench of FIG. 1.

Looking to FIG. 2, the scar ring 40, cover plate 42, ratchet wheel 44 (FIG. 3), and indicator 48 (FIG. 3) have been removed to provide a view of the one-way freewheel clutch socket 20. The one-way freewheel clutch socket 20 comprises a one-way freewheel clutch member 22 and a plurality of rollers 28. The one-way freewheel clutch socket 20 interacts with an inside surface 32 of the box-end 30 as described in further detail below. According to the orientation of FIG. 2, the wrench 10 is positioned to tighten a nut or bolt (not shown), having right-handed threads, into the page. When a nut or bolt head (not shown) is placed in the one-way freewheel clutch socket 20, it is tightened by rotating the wrench's handle 50 in the direction of arrow A. As the handle 50 is rotated, the plurality of rollers 28 rotate in the same direction thereby wedging themselves between the one-way freewheel clutch member 22 and the inside surface 32. Therefore, the handle 50 and the one-way freewheel clutch. socket 20 are effectively connected and rotate together. When the handle 50 is rotated in the direction of arrow B, the plurality of rollers 28 abut one-way freewheel clutch member walls 24 and spin in place, thereby allowing the handle 50 to rotate independently about the one-way freewheel clutch socket 20.

Figure 3:
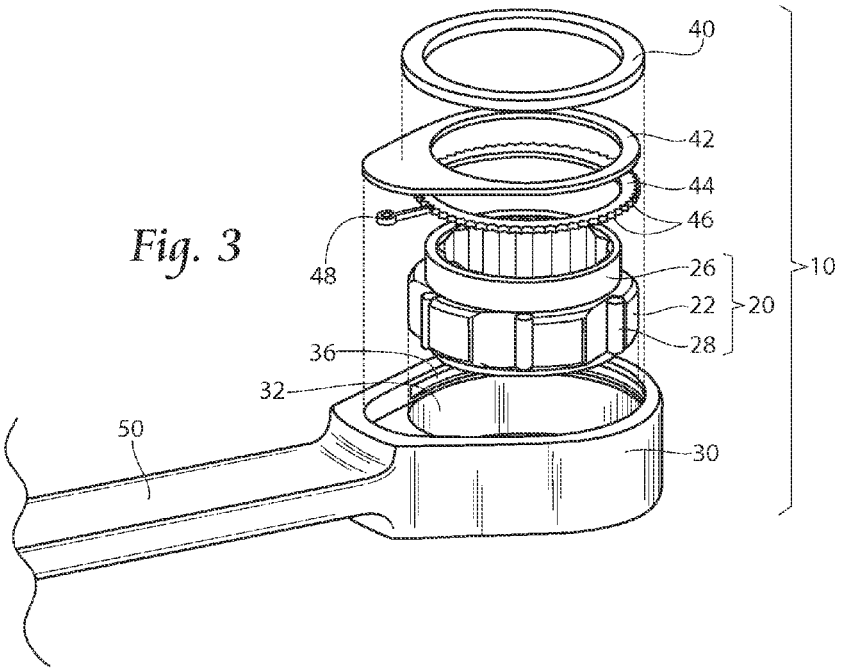
FIG. 3 is an exploded view of the wrench of FIG. 1.

FIG. 3 further illustrates all of the components of the wrench 10 in an exploded view. As shown here, the one-way freewheel clutch member 22 has a collar 26 around which the ratchet wheel 44, the cover plate 42, and the snap ring 40 are placed. The ratchet wheel 44 may be pressed onto the collar 26, or secured in any other fashion which provides a firm connection. Furthermore, machined, or otherwise provided, in the box-end 30 is a pocket 34 (shown in FIG. 2) for the indicator 48, and a groove 36 for the snap ring 40. The indicator 48 is shown as a single leaf spring, but it may comprise multiple offset springs to provide a finer audible feedback.

Figure 4:
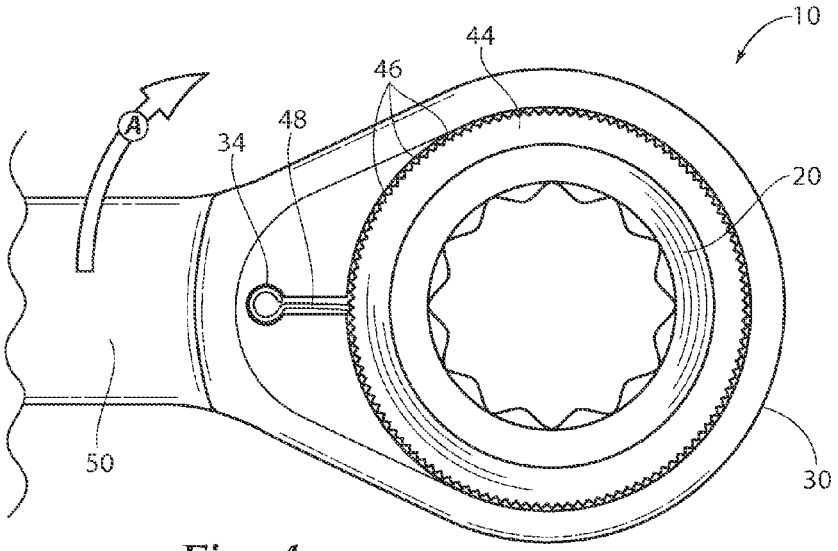
FIG. 4 is a top view of the wrench. of FIG. 1 in use.
Figure 5:
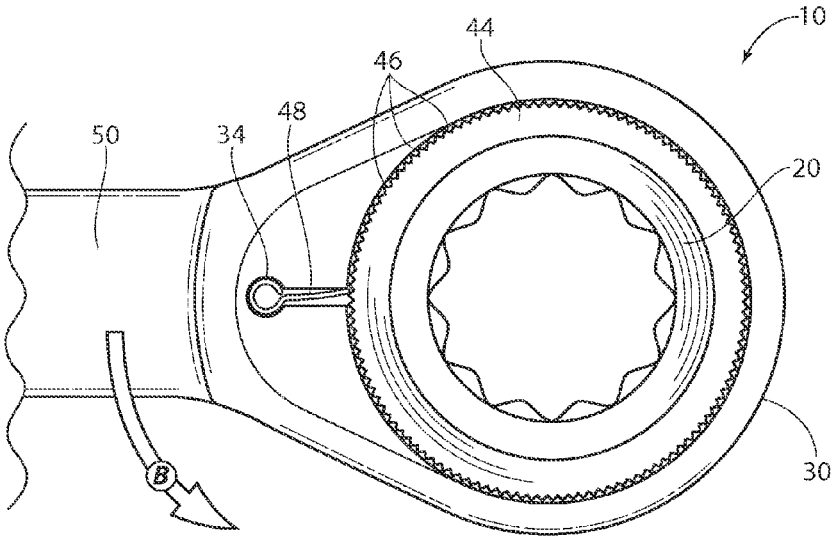
FIG. 5 is a top view of the wrench of FIG. 1 in use.

FIGS. 4 and 5 illustrate how the indicator 48 interacts with the ratchet wheel. 44 depending on whether the wrench handle 50 is turned in the tightening direction (arrow A) or in the "reloading" direction (arrow B). The term "reloading" simply means rotating the handle, in the opposite direction of tightening, to a more advantageous position for a user (not shown) to apply force in the active direction. Furthermore, just as in FIG. 2, FIGS. 4 and 5 are illustrations of the wrench 10 viewed from above in a tightening orientation for right-hand threaded bolts and nuts being turned into the page.

As the handle is turned in the direction of arrow A (FIG. 4), both the one-way freewheel clutch socket 20 and the handle 50 rotate together. Therefore, the ratchet wheel 44 and the indicator 48 do not rotate relative to one another. As the handle is turned in the direction of arrow B (FIG. 5), the handle 50 rotates independent of the one-way freewheel clutch socket 20. Because the indicator 48 rotates with the handle 50, and the ratchet wheel 14 is affixed to the one-way freewheel clutch socket 20, the indicator 48 will ride along the ratchet wheel's teeth 46. The interaction between. the indicator 48 and the teeth 46 will make an audible "clicking" sound. and therefore provides tactile feed hack to the user that the handle 50 is rotating independently from the one-way freewheel clutch socket. 20. Therefore, the "clicking" sound is independent of the mechanics of the wrench reloading, but the "clicking" sound is still directly related to the reloading. The characteristics of the "clicking" (e.g., tone and timing) may be modified without changing the mechanics of the one-way freewheel clutch socket 20.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A gearless wrench comprising:

a box end having an inside surface;

a freewheel clutch socket positioned within the box end;

the freewheel clutch socket comprising a freewheel clutch member, a collar extending coaxially from the freewheel clutch member, and a plurality of rollers located between the freewheel clutch member and the inside surface of the box end;

the freewheel clutch member configured to engage with the box end and rotate in a first rotational direction and disengage with the box end and rotate relative to the box end in a second rotational direction;

a ratchet wheel, with ratchet teeth, securely fastened to the collar of the freewheel clutch socket;

an indicator placed within the box end and in contact with the ratchet teeth; and the indicator configured to interact with the ratchet wheel when the freewheel clutch member rotates in the second rotational direction and not to substantially contribute to the engagement of the freewheel clutch member with the box end when the freewheel clutch member rotates in the first rotational direction.

2. The gearless wrench according to claim 1, further comprising:

a snap-ring groove located in the box end;

a cover plate configured to cover the ratchet wheel and the indicator; and a snap-ring positioned against the cover plate and within the snap-ring groove to retain the freewheel clutch socket and the ratchet wheel, the indicator, and the cover plate within the box end.

3. The gearless wrench of claim 1, wherein the indicator is a leaf spring.

4. The gearless wrench of claim 1, wherein the indicator comprises a plurality of leaf springs.

5. The gearless wrench of claim 1, wherein the ratchet wheel is friction-fit to the collar of the freewheel clutch socket.

6. A gearless wrench configured to provide auditory and/or tactile feedback during reloading, the gearless wrench comprising:

a box end comprising an inside surface and an indicator pocket;

a freewheel clutch socket positioned within the box end;

the freewheel clutch socket comprising a freewheel clutch member, a collar extending coaxially from the freewheel clutch member, and a plurality of rollers located between the freewheel clutch member and the inside surface of the box end;

the freewheel clutch member configured to engage with the box end and rotate in a first rotational direction and disengage with the box end and rotate relative to the box end in a second rotational direction;

a ratchet wheel, with ratchet teeth, securely fastened to the collar of the freewheel clutch socket;

an indicator placed within the indicator pocket and in contact with the ratchet teeth; and the indicator configured to interact with the ratchet wheel when the freewheel clutch member rotates in the second rotational direction and not to substantially contribute to the engagement of the freewheel clutch member with the box end when the freewheel clutch member rotates in the first rotational direction.

7. The gearless wrench according to claim 6, further comprising:

a snap-ring groove located in the box end;

a cover plate configured to cover the ratchet and the indicator; and a snap-ring positioned against the cover plate and within the snap-ring groove to retain the freewheel clutch socket and the ratchet wheel, the indicator, and the cover plate within the box end.

8. The gearless wrench of claim 6, wherein the indicator is a leaf spring.

9. The gearless wrench of claim 6, wherein the indicator comprises a plurality of leaf springs.

10. The gearless wrench of claim 6, wherein the ratchet wheel is friction-fit to the collar of the freewheel clutch socket.

* * * * *